US005301413A

United States Patent [19]

Habegger et al.

[11] Patent Number: 5,301,413

[45] Date of Patent: Apr. 12, 1994

[54] MODULAR RECLINING CHAIR AND METHOD OF MAKING

[75] Inventors: Douglas A. Habegger, Millbury, Ohio; Larry P. LaPointe, Temperance, Mich.; Clifford K. Weyher, Maybee, Mich.; Jonathan R. Saul, LaSalle, Mich.; Karl J. Komorowski, Petersburg, Mich.

[73] Assignee: La-Z-Boy Chair Co., Monroe, Mich.

[21] Appl. No.: 772,231

[22] Filed: Oct. 11, 1991

[51] Int. Cl.[5] ..... A47C 1/02; B23P 11/00

[52] U.S. Cl. ..... 29/436; 29/434; 297/83; 297/342

[58] Field of Search ..... 29/91, 91.1, 434, 436; 297/83, 85, 259, 317, 318, 322, 329, 271, 340, 341, 342, 343, 344, DIG. 7

[56] References Cited

U.S. PATENT DOCUMENTS

| | | |
|---|---|---|
| 1,048,306 | 12/1912 | Greilick . |
| 2,677,412 | 5/1954 | Thomas . |
| 2,918,110 | 12/1959 | Schliephacke . |
| 2,918,111 | 12/1959 | Schliephacke . |
| 2,919,745 | 1/1960 | Schliephacke . |
| 3,096,121 | 7/1963 | Knabusch et al. . |
| 3,567,280 | 3/1971 | Bradshaw . |
| 3,858,932 | 1/1975 | Crum et al. . |
| 3,904,240 | 9/1975 | Rogers, Jr. et al. . |
| 4,071,275 | 1/1978 | Rogers, Jr. . |
| 4,226,469 | 10/1980 | Rogers, Jr. et al. . |
| 4,291,913 | 9/1981 | Kowalski . |
| 4,364,603 | 12/1982 | Johnson . |
| 4,367,895 | 1/1983 | Pacitti et al. . |
| 4,740,031 | 4/1988 | Rogers, Jr. . |
| 5,011,220 | 4/1991 | LaPointe . |

*Primary Examiner*—Timothy V. Eley
*Attorney, Agent, or Firm*—Harness, Dickey & Pierce

[57] ABSTRACT

A modular reclining chair and method for assembling it are disclosed. The modular reclining chair includes a simplified actuation mechanism which significantly reduces system complexity and weight while providing improved comfort to the seat occupant. The construction is such that the pre-assembled actuation mechanism is integrally suspended from and interdependent with box-like modular frame components. In this manner, the frame components can be upholstered prior to final assembly with the actuation mechanism.

43 Claims, 7 Drawing Sheets

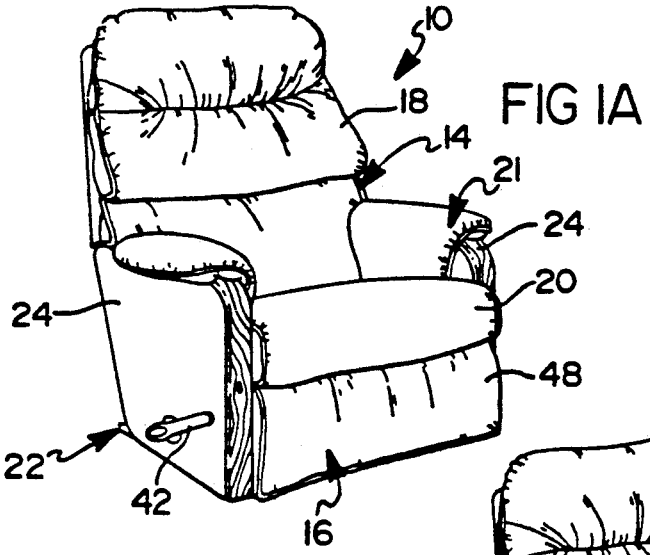
FIG IA
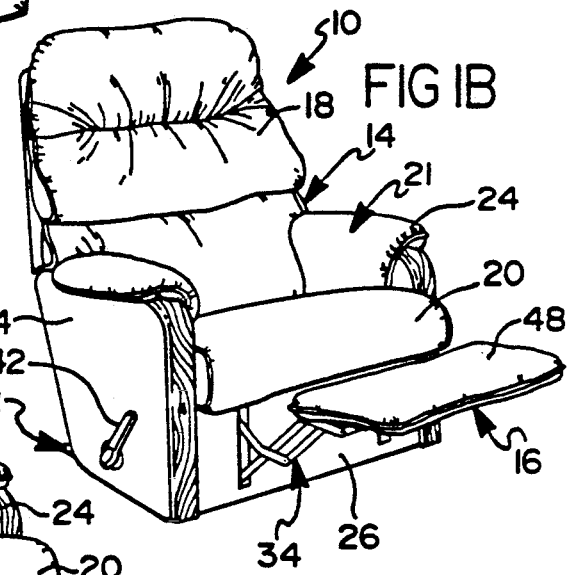
FIG IB
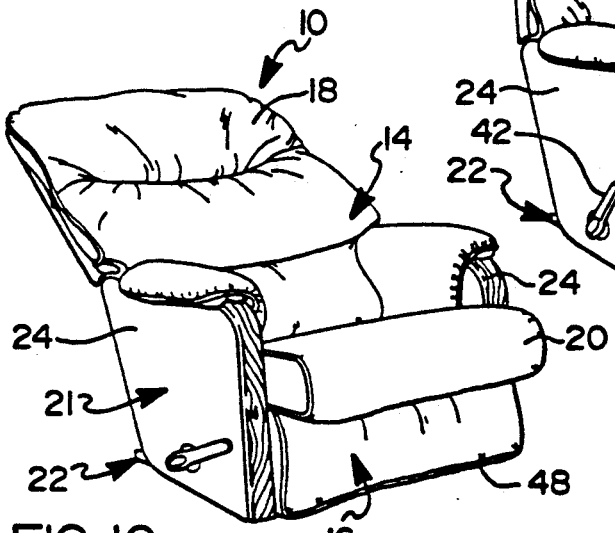
FIG IC
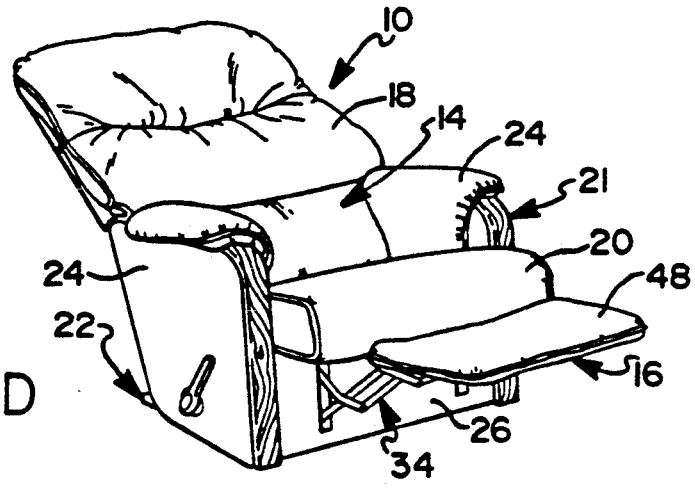
FIG ID

MODULAR RECLINING CHAIR AND METHOD OF MAKING

BACKGROUND OF THE INVENTION

The present invention relates generally to reclining chairs and, more particularly, to a method for assembling an improved reclining chair from pre-assembled modular components.

Traditionally, reclining chairs are equipped with an actuation mechanism which is operatively interconnected between a prefabricated chair frame and a stationary base assembly. In general, the actuation mechanism is a combination of various mechanical linkages operable for providing various comfort features such as independent reclining movement of a seat assembly as well as actuation of an extensible leg rest assembly. Due to its relative complexity, it is common practice in the furniture industry to assemble the various mechanical linkages of the actuation mechanism into a stand alone mechanism frame assembly. A prefabricated U-shaped chair frame is frequently bolted around the mechanism frame with the open portion of the "U" corresponding to the front of the chair. In addition, the seat assembly is supported from the mechanism frame assembly for reclining movement with respect to the chair frame. Accordingly, such reclining chairs having a mechanism frame within a wood chair frame are commonly referred to as having a "frame within a frame" construction. As such, most furniture manufacturers do not upholster the exterior surfaces of the prefabricated chair frame until after the mechanism frame assembly has been installed. Unfortunately, the upholstering operation is very inefficient and expensive in that the frequently heavy and cumbersome prefabricated chair frame must be manually manipulated in an extremely labor-intensive manner.

In traditional reclining chair construction technique, the free ends of the U-shaped frame are attached on opposite sides at the front of the mechanism frame. However, the conventional mechanism frame typically comprises a narrow rail as the front frame member in order to prevent interference with the pantograph linkage that protrudes from the front of the chair during extension and retraction of the leg rest member. Accordingly, due to the small connection surface between the free ends of the U-shaped chair frame and the front member of the mechanism frame, the free ends of the U-shaped chair frame, which typically comprise chair arms, are susceptible to an undesirable degree of lateral deflection when side-to-side pressure is applied to the chair arms.

While many conventional reclining chairs operate satisfactorily, furniture manufacturers are continually striving to develop improved frames and actuation mechanisms for reducing system complexity and increasing structural soundness and smoothness of operation as well as occupant comfort. Furthermore, there is a continuing desire to develop improved fabrication and assembly techniques which will result in reduced costs while promoting increased efficiency and improved product quality.

SUMMARY OF THE INVENTION

In accordance with the principles of the present invention, an improved method for assembling an article of furniture is disclosed which is designed to overcome the disadvantages traditionally associated with fabricating, assembling and upholstering reclining-type chairs. Therefore, a primary object of the present invention is to provide a reclining chair which can be simply, efficiently, and rigidly assembled so as to significantly reduce its overall complexity, weight, and cost while providing improved operation and comfort to the seat occupant.

It is an additional object of the present invention to provide a three-way reclining chair which is adapted to permit selective and independent "reclining" movement of a seat back relative to a seat member as well as actuation (i.e. extending and retracting) of a leg rest assembly. As such, the present invention provides a reclining chair wherein the minimal force achieved via shifting the weight of the seat occupant is utilized as the primary means for moving the seat assembly between an "upright" position and a "reclined" position.

It is another object of the present invention to reduce the input force exerted by the seat occupant for smoother operation of the actuation mechanism. As a related object, the complexity of improved actuation mechanism has been significantly simplified to incorporate mechanical linkage and drive components optimally designed for substantially reducing frictional losses so as to promote easier and smoother actuation. Moreover, the various operative linkages are designed to permit "pre-assembly" of the actuation mechanism without utilization of a conventional mechanism frame assembly.

It is still another object of the present invention to provide a simplified recliner chair frame which is structurally rigid, easy to assemble, and reduces lateral or "side-to-side" deflection of the chair arms.

In a preferred embodiment of the present invention, the integrated or "knockdown" construction of the reclining chair facilitates application of unique fabrication and assembly techniques which effectively result in increased production efficiency and cost savings while concomitantly producing a high-quality article of furniture. In general, the construction of the reclining chair is such that the pre-assembled actuation mechanism cannot be divorced from the pre-upholstered frame components which, when assembled, are rigidly interconnected to define a "box-like" chair frame or body from which the pre-assembled actuation mechanism is integrally suspended. In this manner, the conventional construction of supporting the actuation mechanism within a separate and distinct mechanism frame assembly is no longer required. The pre-assembled actuation mechanism includes a drive rod and a front support shaft which are each directly supported between left and right upholstered side frame assemblies. As such, extremely precise alignment of the actuation mechanism with respect to each of the separate pre-upholstered frame components is possible. Moreover, unique front and rear cross-rail assemblies interconnect the left and right side frame assemblies to define a "unitized" and extremely rigid box-like chair frame or body for inhibiting side-to-side flexion of the actuation mechanism suspended therein as well as of the side frame assemblies themselves. In addition to the structural and functional advantages associated with the modular reclining chair of the present invention, a unique method of assembling the preassembled actuation mechanism as an integrated component within the pre-upholstered frame components is disclosed.

The leg rest assembly may be operated by the seal occupant rotating an actuator lever through a limited angle which, in turn, rotates the drive rod for selectively extending or retracting a pair of leg rest pantograph linkages. The pantograph linkages are uniquely suspended for synchronous actuation between the drive rod and the front support shaft and protrude through elongated apertures provided in the front cross-rail assembly. In addition, an over-centered toggle mechanism is provided to assist in extending and retracting the leg rest assembly and in retaining the leg rest assembly in its "extended" and "stowed" positions.

Furthermore, the present invention relates to an improved combination reclining and platform rocking chair which can be used as a conventional rocker or as a reclining chair. The combination reclining/rocking chair is constructed and balanced such that normal rocking movement between the chair body and the stationary base assembly is permitted without causing the seat assembly to recline, but which can be quickly and easily reclined when desired. In addition, latching means are provided for permitting the seat occupant to selectively "lock" the chair body in a multitude of rearwardly "tilted" positions to arrest the rocking action upon initial extension of the leg rest assembly to its extended position. Independent of such action, slight backward pressure applied to the seat back is operable to initiate reclining movement of the seat assembly. Accordingly, an infinite number of reclined positions may be achieved upon the seat occupant shifting his or her body weight against the seat back.

Additional objects, advantages, and features of the present invention will become apparent from the following description and appended claims, taken in conjunction with the accompanying drawings.

DESCRIPTION OF THE DRAWINGS

FIGS. 1A through 1D are perspective views of an exemplary reclining chair apparatus shown in various operative positions, the "modular" components of which have been fabricated and assembled in accordance with the principles of the present invention;

DETAILED DESCRIPTION OF THE INVENTION

Figure 2:
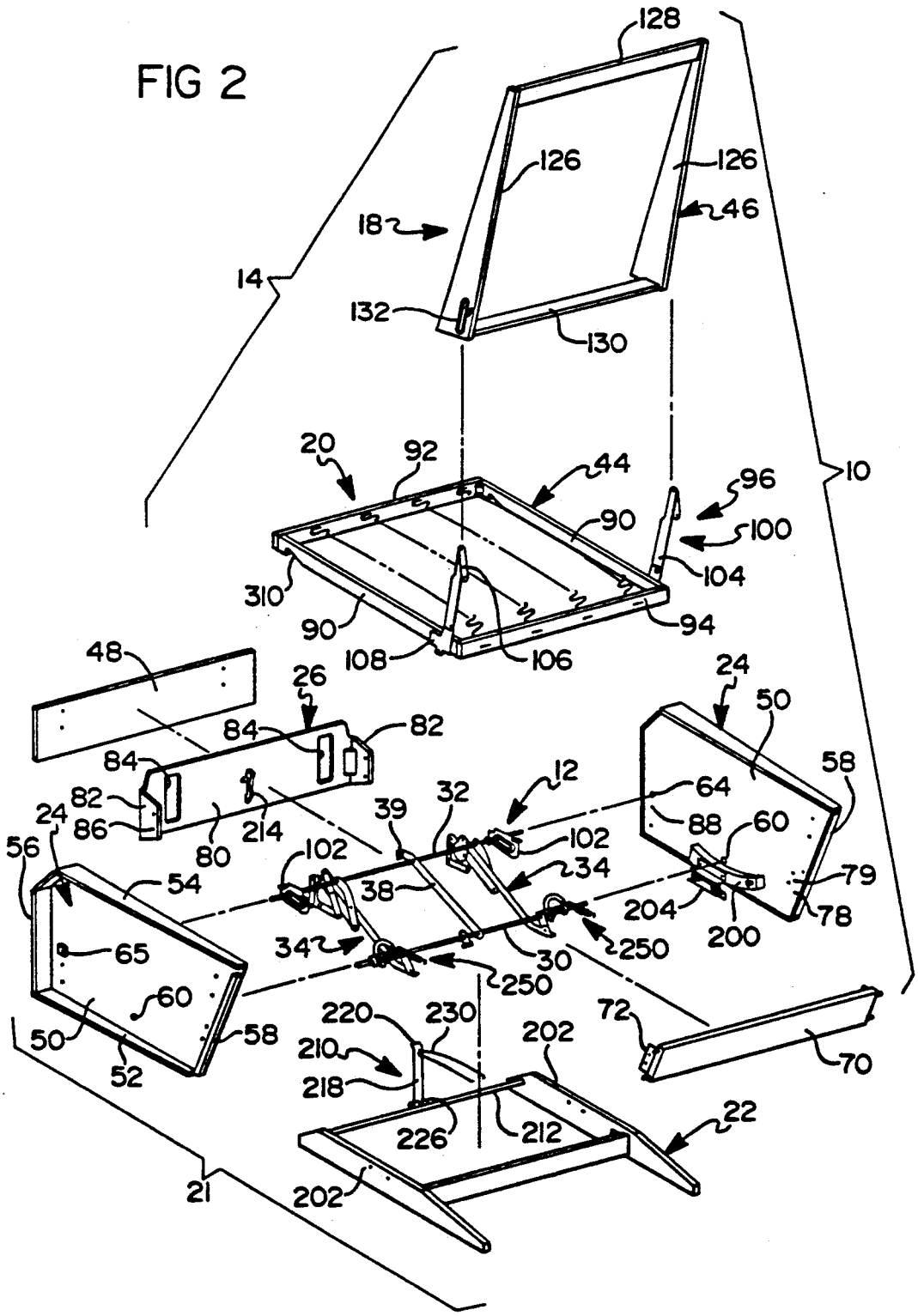
FIG. 2 is an exploded perspective view of a reclining chair of the type shown in FIG. 1 with upholstery, springs and other parts removed from the pre-assembled components for illustrating their integrated and interdependent association with an improved actuation mechanism.

In accordance with the teachings of the present invention, an improved actuation mechanism for use in single and multi-person articles of furniture (i.e. chairs and sofas or loveseats) is disclosed. In addition, the present invention is also directed to a method of assembling the improved actuation mechanism as a pre-assembled and "integrated" component of a reclining-type chair or the like. As will be described, the pre-assembled actuation mechanism is uniquely suspended in a "fixed" three-pivot-point arrangement from integral pre-upholstered box-like frame components so as to provide precise mechanical alignment and superior structural rigidity while concomitantly facilitating application of highly efficient fabrication and assembly processes.

The actuation mechanism of the present invention is a "three-way" mechanism which can be actuated to independently "recline" a seat back relative to a seat member or move a leg rest assembly between "retracted" and "extended" positions. Moreover, a full range of independent "reclining" movement of the seat back relative to the seat member is possible regardless of the operative position of the leg rest assembly between its fully "retracted" and "extended" positions.

In the disclosed embodiment, the article of furniture is shown as a combination recliner and platform rocker, hereinafter referred to reclining/rocking chair 10, which includes a pre-assembled actuation mechanism 12 and various upholstered frame components that can be quickly and simply modularly assembled as a seating unit. Such "modular" construction provides a significant advancement over conventional furniture fabrication and assembly techniques since manipulation of heavy and cumbersome "unitized" chair frames during upholstery installation is no longer required. As such, each frame component or frame sub-assembly can be upholstered prior to modular assembly to actuation mechanism 12 so as to improve individual component quality as well as overall system quality and production efficiency. Moreover, since actuation mechanism 12 of the present invention is relatively compact in size, the use of loose upholstered cushions, which is an important feature in marketing various styles of chair, sofa or loveseat furniture, is also possible.

With particular reference now to the drawings, the functional and structural aspects of actuation mechanism 12, shown operably suspended from the various pre-upholstered box-like frame components of recliner/rocker chair 10, will now be described. More particularly, FIG. 1A depicts an exemplary combination reclining/rocking chair 10 having its seat assembly 14 shown in a fully "upright" position for permitting a seat occupant to enjoy conventional seating. FIG. 1B illustrates reclining/rocking chair 10 in the "upright" position with its associated leg rest assembly 16 shown protracted to its "extended" position.

As seen in FIG. 1C, seat assembly 14 includes a seat back 18 shown in a "reclined" position relative to a seat member 20 while leg rest assembly 16 is positioned in its retracted or "stowed" position. As is known, reclining movement of seat assembly 14 is accomplished by the seat occupant deliberately applying pressure to seat back 18 such that a seat swing mechanism causes seat member 20 to move forwardly and upwardly for maintaining seating comfort while the included angle increases therebetween. Chair 10 may be easily returned to its "upright" position upon deliberate application of rearward pressure to seat assembly 14 or, more simply, if the seat occupant leans forward to remove pressure from seat back 18. Finally, FIG. 1D shows seat assembly 14 of chair 10 in the "reclined" position with its respective leg rest assembly 16 protracted to the "extended" position. In accordance with the embodiment shown, and as will be described from the following disclosure, the entire chair body 21 can be easily "rocked" with respect to stationary base assembly 22.

In accordance with a primary design feature of the present invention, the various pre-assembled and upholstered frame components provided for operably suspending actuation mechanism 12 within reclining/rocking chair 10 will now be clearly described. For purposes of clarity, FIG. 2 shows the various pre-assembled frame components with their upholstery, padding, springs, etc. removed to better illustrate the interdependency of the frame components construction which can be rapidly and rigidly assembled in a relative easy and efficient manner. Therefore, all of the frame components can be individually fabricated or sub-assembled to include the requisite brackets, springs, padding and upholstery on an "off-line" batch-type basis. Thereafter, the various pre-assembled and upholstered frame components are assembled for totally integrating actuation mechanism 12 therein.

Figure 3:
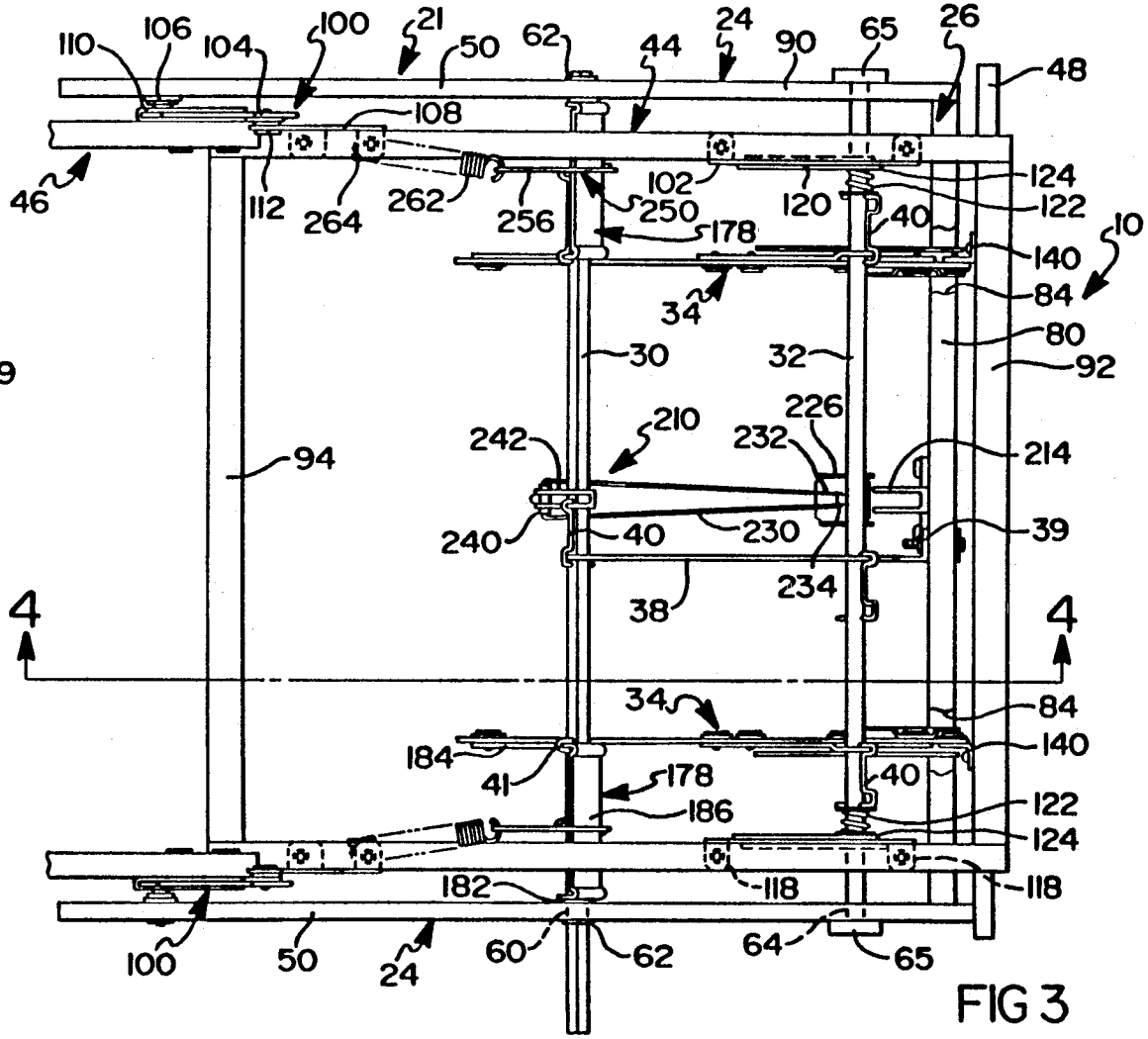
FIG. 3 is a partial plan view of the reclining chair shown in FIG. 2.
Figure 4:
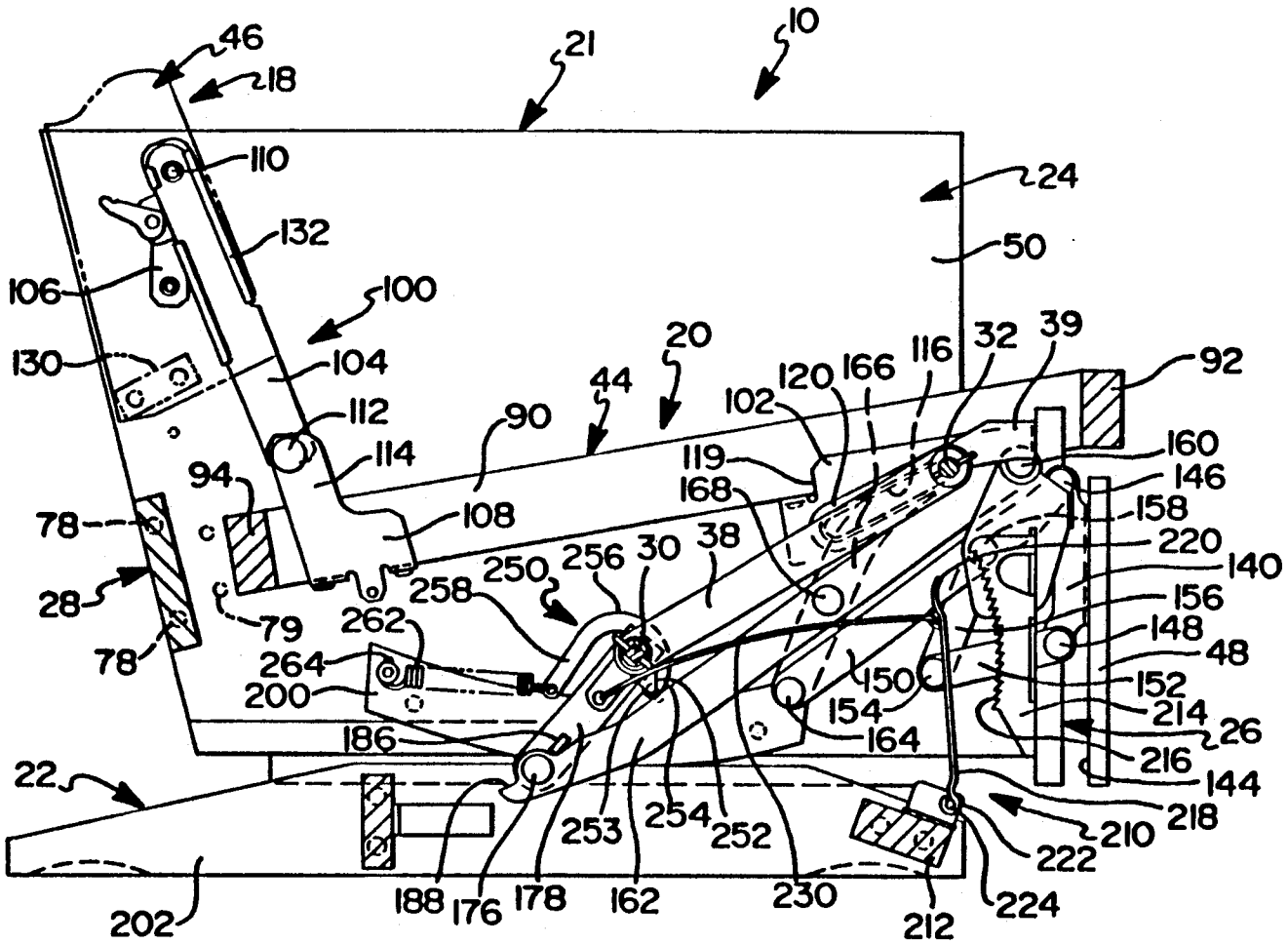
FIG. 4 is a sectional view, taken along line 4—4 of FIG. 3, illustrating the reclining chair in an "upright" position.

As seen in FIGS. 2 through 4, actuation mechanism 12 of reclining/rocking chair 10 is integrated into and operably suspended from left and right side frame assemblies 24. In addition to side frame assemblies 24, reclining/rocking chair 10 also includes front and rear rail assemblies 26 and 28, respectively, which when interconnected define a rigid "box-like" chair frame. As will be described in greater detail hereinafter, actuation mechanism 12 is pre-assembled to include a drive rod 30 and front support shaft 32, both of which are spatially oriented to be precisely located and "suspended" from left and right side frame assemblies 24.

With continued reference to FIGS. 2 through 4, actuation mechanism 12 is shown to support leg rest assembly 16 thereon. More specifically, leg rest assembly 16 includes left and right pantograph linkage mechanisms 34 and left and right spring-assisted toggle mechanisms 36 which are operably associated with drive rod 30 and front support shaft 32 for permitting the seal occupant to selectively actuate leg rest assembly 16. A rigid cross-brace 38 is secured between drive rod 30 and support shaft 32 for providing structural rigidity within actuation mechanism 12. One end of cross-brace 38 is journally supported on drive rod 30 while the opposite end thereof is configured as a bracket 39 which is fixedly secured (such as by a suitable threaded fastener) to an inner surface of front rail assembly 26. Furthermore support shaft 32 is fixed to an intermediate portion of cross-brace 38 via a spacer clip 40 to inhibit rotation of support shaft 32 upon rotation of drive rod 30. In the preferred construction, drive rod 30 is an elongated square shaft having a handle portion 42 provided adjacent an upholstered exterior portion of one of side frame assemblies 24 that can be easily reached by a person seated in chair 10 for convenient actuation thereof.

As best seen in FIG. 2, most of the structural frame components such as side frame assemblies 24, front rail assembly 26, rear rail assembly 28, seat frame 44, seat back frame 46 and leg rest frame board 48 are each constructed in a manner which enables them to support springs, padding, upholstery, etc. in order to complete a decorative and stylish reclining/rocking chair 10 similar to that shown in FIGS. 1A through 1D. Preferably, each of these frame components is fabricated from one or more wood panels and/or rails that are fixedly secured together by suitable fasteners, such as dowels, staples, nails and screws, and which may be reinforced at critical joints by metal reinforcement plates or brackets and/or wood corner blocks in a known manner. As previously noted, each frame component is individually pre-assembled for subsequent assembly into a modular chair 10. However, it is to be understood that the specific construction shown for each frame component is merely exemplary in nature.

Left and right side frame assemblies 24 are each constructed as rigid, roughly rectangular frame components having a universal side panel 50 and horizontal bottom and top members 52 and 54, respectively, with top members 54 also functioning as chair arms. Each side frame assembly 24 also includes a front post 56 which preferably has at least a lower portion substantially perpendicular to the floor. In addition, each side frame assembly 24 has an inclined rear post member 56 such that front and rear posts 56 and 58, respectively, and top and bottom horizontal members 54 and 52, respectively, are each rigidly secured to a side panel 50. Moreover, side panels 50 have a first set of aligned bores 60 formed therein that are sized to receive opposite ends of drive rod 30. In addition, sleeve journals 62 are retained within bores 60 and are sized to permit rotation of drive rod 30. As such, aligned bores 60 define a first set of "fixed" pivot or suspension points that are seated directly within side panels 50. In this manner, drive rod 30 has a fixed pivot arrangement and not a conventional "floating" type which typically required additional linkages.

Side panels 50 also include a second set of aligned bores 64 oriented to receive opposite ends of support shaft 32 therein. Aligned bores 64 are interrupted by a scab block 65 secured to an exterior surface of side panels 50 to define "blind bores" for assisting in properly aligning (i.e. centering) support shaft 32 within chair 10 upon final assembly of the various frame components. As previously noted, spacer clip 40 positively locates rigid cross-brace 38 with respect to support shaft 32 for maintaining the desired "side-to-side" positioning of support shaft 32. As such, aligned bores 64 are seated directly in side panels 50 to define a second set of "fixed" pivot or suspension points. Since the first and second sets of aligned bores 60 and 64, respectively, are oriented in a predetermined arrangement on side panels 50, it is apparent that all critical hole locations for left and right side panels 50 may be drilled in a single operation. Therefore, pre-assembly of actuation mechanism 12 facilitates "final" assembly of chair 10 since drive rod 30 and support shaft 32 are oriented and retained (via cross-brace 38) for receipt within aligned bores 60 and 64, respectively. Side panels 50 do not become "left" or "right" until the members 52, 54, 56, and 58 are affixed, and sleeve journals 62 are installed in aligned bores 60, and T-nuts are inserted within bores 79 and 88 (described below). By thus providing side panels 50 as a universal component, the accuracy of locating aligned bores 60 and 64 is greatly enhanced.

With continued reference to the exploded perspective view of FIG. 2, means for rigidly securing front and rear rail assemblies 26 and 28, respectively, to side frame assemblies 24 for integrally suspending actuation mechanism 12 within a rigid "box-like" chair frame is disclosed. More particularly, rear rail assembly 28 includes a laterally extending cross-member 70 and left and right angled brackets 72 secured to the inner face surface thereof. One or more locator pins or dowel pins 76 provided on the opposite ends of cross-member 70 are adapted to be inserted into corresponding sets of aligned locator holes 78 formed in side panels 50 for properly locating rear rail assembly 28 with respect to side frame assemblies 24. Thereafter, suitable fasteners are used for fixedly securing angled brackets 72 and, in turn, rear rail assembly 28 directly to the inner surface of side panels 50. Preferably, T-nuts are retained within bores 79 formed in side panels 50 for receiving threaded fasteners therein to rigidly secure rear rail assembly 28 between the left and right side frame assemblies 24. Typically, an upholstered rear "tailgate" (not shown) is stapled to rear cross-member 70 since cross-member 70 is not generally upholstered.

Front rail assembly 26 includes a laterally extending planar front cross-member 80 having rearwardly extending side plates 82 fixedly secured in close proximity to its opposite lateral ends. As will be appreciated, front cross-member 80 includes enlarged apertures 84 which are sized to permit leg rest pantograph linkages 34 to move therethrough during extension and retraction of leg rest assembly 16. In addition, front cross-member 80 is upholstered prior to assembly between side frame assemblies 24. Side plates 82 include bores 86 which are alignable with bores 88 formed in side panels 50 to permit front rail assembly 26 to be rigidly secured between left and right side frame assemblies 24. Again, in a preferred construction, T-nuts are retained within bores 88 for receiving suitable threaded fasteners therein.

Front cross member 80 is considerably deeper in top to bottom dimension than front mechanism frame members utilized in many conventional recliner chairs. Whereas the latter may have a top to bottom dimension ranging from approximately ¾ inch to 1 ½ inches, the front cross member 80 has a corresponding dimension of approximately 8 inches at its lateral ends. This increased dimension provides a substantially broader surface for connection of the front rail assembly 26 to side frame assemblies 24. When assembled, this increased connection surface and box-like construction results in a very rigid chair frame. In addition, the enlarged connection surface enhances the rigidity of the chair arms thereby significantly reducing any deflection of the arms due side-to-side pressure applied thereagainst. Undesirable amounts of such deflection are common in prior known recliner chairs in which the minimal connection surface between the chair arms and the front member of the mechanism frame acts like a "pivot" or "point" type connection.

Figure 3A:
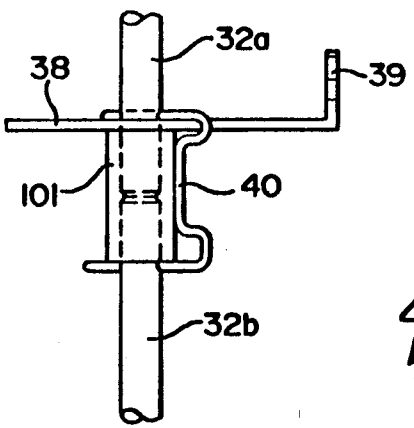
FIG. 3A is a partial plan view of the reclining chair of FIG. 3 showing an alternative embodiment of support shaft 32.

For additional structural frame rigidity and to eliminate any potential for squeaking between frame components, front and rear rail assemblies 26 and 28 may also be glued to side frame assemblies 24 (in addition to the use of conventional fasteners). In carrying out this step, glue is applied between dowel pins 76 and locator holes 78 of side frame assemblies 28. Glue is also applied between side plates 82 of front rail assembly 26 and side frame assemblies 28. When the structural frame components of chair 10 are glued together the front and rear rail assemblies 26 and 28 are no longer readily disassembled from side frame assemblies 24 for servicing actuation mechanism 12 in a conventional fashion should the need arise. When the structural frame components of chair 10 are glued together the actuation mechanism 12 still is capable of being disassembled for servicing. To accomplish such disassembly support shaft 32 is cut at a location that corresponds to the center of the spring clip 40 that is attached to support shaft 32 at cross-brace 38. The two halves **32*a* and 32*b* of support shaft 32 that are created can then be removed from the aligned bores 64 and the various components of actuation mechanism 12 suspended therefrom can also be removed by removing the remaining spring clips 40 and sliding each of the halves 32*a* and 32*b* laterally away from bores 64. If it is necessary to service the drive rod 30 or any of the components of actuation mechanism 12 suspended therefrom, drive rod 30 can be removed from the actuation mechanism by removing spring clip 40 and spacer clips 41 and simply sliding the drive rod laterally away from chair 10 through one of aligned bores 60. When the service work on chair 10 is completed, actuation mechanism 12 is reassembled by threading drive rod 30 through one of aligned bores 60 and the various actuation mechanism components that are to be suspended therefrom until drive rod 30 is journally situated and aligned in both aligned bores 60. Spring clip 40 and spacer clips 41 are then reinserted. In similar fashion, one end of each of (the same or new) halves 32*a* and 32*b* of support shaft 32 is threaded through the various actuation mechanism components that are to be suspended therefrom until the end is positioned in one of the aligned bores 64. A cylindrical coupling 101 is then slid over the free end of one of the support shaft 32 halves. When the free ends of shaft 32 are aligned the cylindrical coupling 101 is then slid laterally over both ends to retain the halves of support shaft 32 in proper alignment. As shown in FIG. 3A, cylindrical coupling 101 is positioned with respect to the free ends of halves 32*a* and 32*b* so that it abuts against the right hand edge of cross-brace 38. Spring clip 40 that is attached to support shaft 32 at cross-bores 38 can still be reinserted to prevent rotation of support shaft 32 once the coupling 101** is in place.

As best seen in FIGS. 2 and 3, seat frame 44 is located between and supported for reclining movement on side frame assemblies 24. More specifically, seat frame 44 is a rigid rectangular structure having left and right side bars 90 which are rigidly secured to opposite ends of front and rear cross pieces 92 and 94, respectively. In view of the compact nature of actuation mechanism 12, seat frame 44 is non-contoured (i.e. "flat") which also permits use of loose cushions, if desired. Seat frame 44 is supported for movement relative to side frame assemblies 24 by means of a seat swing mechanism 96 for causing seat frame 44 to move substantially horizontally and slightly up or down, depending on whether seat frame 44 moves forwardly (during "reclining" movement) or rearwardly (on return to the "upright" position). Seat swing mechanism 96 includes left and right hand rear swing linkages 100 and left and right hand front slide brackets 102. Rear swing linkages 100 extend 100 extend vertically well above the level of seat frame 44 along rear posts 58 of side frame assemblies 24. Each rear swing linkage 100 includes an elongated swing link 104, a support bracket 106 and a seat bracket 108. An upper end of each swing link 104 is pivotably connected just below chair arm 54 to support bracket 106 which, in turn, is fixedly secured to its corresponding side panel 50. As such, pivot points 110 between swing links 104 and support brackets 106 define a third set of "fixed" pivot or suspension points that are seated directly in side panels 50.

The lower end of each rear swing link 104 is pivoted about a pivot point 112 to an upstanding post section 114 of seat bracket 108. Seat bracket 108 has a horizontal flange portion that is securely fixed (such as by wood screws) to an underside surface of a seat side bar 90 in relatively close proximity to the back end of seat frame 44. As such, loading on the rear of seat frame 44 passes from seat brackets 108 and pivots 112 into rear swing links 104 as tension loading which is transferred by way of pivots 110 and support brackets 106 into side frame assemblies 24 of chair 10. Rear swing links 104 are elongated to provide increased leverage for balanced reclining action. Thus, the rear of seat frame 44 moves much like a controlled pendulum on and below upper pivots 110. Accordingly, seat 20 can be preassembled and upholstered prior to final assembly. While not considered necessary to provide superior balanced comfort, left and right tension springs (not shown) may be installed between seat bracket 108 and a rearward stationary chair frame component to provide augmented resistance to reclining movement of seat assembly 14 for heavier seat occupants.

As mentioned, seat swing mechanism 96 also includes a pair of (i.e. left and right) front slide brackets 102 which are operable to guide and limit fore and aft movement of seat frame 44 and, in turn, seat 20. More particularly, front support shaft 32 extends through lost-motion slots 116 formed in left and right slide brackets 102 which have horizontal flanges 118 securely fixed (such as by wood screws) to an underside surface of seat side bars 90 in relatively close proximity to the front end of seat frame 44. In addition, slide brackets 102 also include elongated vertical flanges 119 which are adapted to be retained against the inner side surface of seat side bars 90.

As will be appreciated, the angularity and length of slots 116 define the range of fore and aft movement of seat frame 44 relative to chair body 21 upon the seat occupant applying a force to move seat assembly 14 between the "upright" and "reclined" positions. In addition, means are also provided for generating a predetermined amount of frictional drag upon movement of seat frame 44 with respect to support shaft 32. In particular, a nylon insert 120 is fixedly retained within lost-motion slots 116. Compression springs 122 are provided which concentrically surround opposite ends of support shaft 32 for biasing a disk-like washer 124 into frictional engagement with an inner surface of nylon insert 120 adjacent slot 116. Nylon insert 120 is operable with compression springs 122 for controlling friction resistance to movement of the front end of seat assembly 20 with respect to support shaft 32 while concomitantly acting to effectively dampen noise. Left and right spacer clips 40 are provided for preloading springs 122 and for positively locating and retaining pantographic leg rest linkages 34 on support shaft 32 while inhibiting rotation of support shaft 32. Therefore, slide brackets 102, inserts 120, washers 124, springs 122 and spacer clips 40 are pre-assembled onto support shaft 32.

Seat back 18 is constructed to include seat back frame 46 that is in the form of a rigid relatively rectangular assembly. Seat back frame 46 includes right and left hand side members 126 and upper and lower crosspieces 128 and 130, respectively. As is known, seat back frame 46 can be removably mounted on an upper portion of rear swing links 104 by means of slide brackets 132 secured at suitable locations on side members 126. A preferred construction of slide brackets 132 for this type of mounting is shown and described in U.S. patent application Ser. No. 07/621,239 filed Nov. 30, 1990, assigned to the common assignee of the present invention, the disclosure of which is expressly incorporated by reference herein. In general, slide brackets 132 are channel-shaped to provide an interior track that slidably receives rear swing links 104 therein. When slide brackets 132 are mounted on rear swing links 104, seat back 18 is, in effect, an extension of rear swing links 104 above pivot points 110. As such, seat back 18 can be pivoted about pivots 110 for acting as a lever arm for causing relatively easy angularly movement of rear swing links 104 and fore and aft movement of seat 20.

Leg rest assembly 16 is shown to include frame board 48 having an outer surface that is padded and upholstered so that finished reclining/rocking chair 10 will be as seen in FIGS. 1A through 1D. Frame board 48 is supported and moved by identical left and right hand pantograph linkages 34. Pantograph linkages 34 are substantially identical in function and structure to that shown in FIG. 3 of U.S. Pat. No. 3,096,121, assigned to the common Assignee of the present invention, with the exception that pantograph linkages 34 are operably suspended about the second set of "fixed" suspension points defined by support shaft 32. For a better understanding of the operation of pantograph linkages 34, a brief description is included herein. More particularly, frame board 48 has an angled bracket 140 secured to its bottom face 144 for each pantograph linkage 34, whereby frame board 48 is pivotably connected at a rear pivot 146 and a front pivot 148 to one end of board links 150 and 152, respectively, of pantographs 34. The opposite end of front board link 152 is pivoted at 154 to an end of a connector link 156 which, in turn, is centrally pivoted at 158 to a portion of rear board link 150. The other end of connector link 156 is pivoted at 160 to a top end of a long support link 162. The other end of rear board link 150 is pivoted at 164 to one end of a curved link 166 which is pivoted at a central pivot 168 to a central portion of long support link 176. The other end of curved link 166 is pivotably connected at pivot 170 to front support shaft 32. As noted, left and right spring clips 40 are provided to maintain the desired spacing between left and right pantograph mechanisms 34 on support shaft 32.

Another point of support is pivot 176 at the curved bottom end of long support link 162 which connects support link 162 to a first end of a drive link 178, the other end of which has a square aligned hole through which square drive rod 30 extends such that drive link 178 is driven by angular movement of drive rod 30. Thus, selective rotation of drive rod 30 turns drive link 178 which acts through pivot 176 to move long support link 162. Such movement of support link 162 causes curved link 166 to swing about "fixed" pivot 170 by virtue of pivot connection 168 that curved link 166 has with long support link 162. The action of link 166 swinging about fixed pivot 170 acts to move rear board link 150 outwardly and upwardly. In addition, pivot 160 at the top end of long support link 162 causes connector link 156 to swing about pivot 158 such that front board link 152 is also moved outwardly and upwardly. This extensible action takes place simultaneously with both the left and right hand pantograph linkages 34 when there is sufficient angular rotation of drive rod 30 via handle 42. In this manner, frame board 40 is moveable between its "stowed" vertical position and its "extend" protracted position.

As best seen in FIG. 3, drive link 178 is generally U-shaped having parallel short and long legs 182 and 184, respectively, joined by a base portion 186 which overlies drive rod 30. Both legs 182 and 184 have square aligned holes through which square drive rod 30 extends. When leg rest assembly 16 is protracted to its fully "extended" position, a cold deformed stop tab 186 on long leg 184 contacts a stop shoulder 188 formed on the lower end of long support link 162 when long leg 184 and link 162 are almost in relatively collinear alignment. Due to engagement of stop tab 186 and stop shoulder 188, further extension of pantograph linkages 34 is inhibited such that leg rest frame 48 is held in an elevated and generally horizontal position.

To provide means for permitting the chair frame 21 to rock relative to base assembly 22, contoured rocker blocks 200 are provided which are secured to inner side faces of side panels 50. Rocker blocks 200 are positioned to engage an upper surface of base assembly 22 in a "rockable" relation therewith. Rocker blocks 200 and left and right side rails 202 of base assembly 22 are interconnected by a double coil spring "rocker" device, generally shown at 204. Preferably, rocker spring device 204 is similar to that disclosed in U.S. Ser. No. 666,348 filed Mar. 8, 1991, commonly owned by the assignee of the present invention, and which is expressly incorporated by reference herein. As will be appreciated, rocker spring device 204 is operable to permit balanced rocking movement of chair body 21 with respect to fixed base assembly 22 without causing seat assembly 14 to recline inadvertently.

In accordance with another comfort feature associated with combination reclining/rocking chair 10, a locking apparatus 210 is provided that is operable to releasably hold chair body 21 in any one of a plurality of rearwardly "tilted" positions upon leg rest assembly 16 being selectively moved to its fully extended position. Locking apparatus 210 is also operable to inhibit subsequent rocking movement of chair body 21 in a forward direction following movement to a desired rearwardly "tilted" position. Preferably, locking apparatus 210 is a ratchet type locking mechanism that is actuated upon angular movement of drive rod 30. In general, locking apparatus 210 acts between front rail assembly 26 of chair body 21 and forward cross-rail 212 of base assembly 22 for providing a number of sequential lockable rearwardly "tilted" positions. One example of a suitable locking mechanism is thoroughly shown and disclosed in the afore-noted U.S. Pat. No. 3,096,121. As incorporated into reclining/rocking chair 10, a contoured sector or rachet bracket 214 is secured to an inner surface of front cross-member 80 and is formed to define a plurality of teeth 216 thereon. A latching bar or pawl 218 having an upper chisel-shaped end 220 is supported from base assembly 22 and is operable to lockingly engage sector teeth 216 for preventing forward rocking movement of chair body 21 following rearward "tilting" movement thereof. As best seen in FIG. 4, latching bar 218 has a hinged bottom end constructed from a cylindrical portion 222 which is secured by a pivot 224 to a mounting bracket 226 that is securely attached to cross-rail 212 of base assembly 22.

A rectangular spring wire 230 has its forward web 232 secured in a stuck-out loop 234 formed in latching bar 218. The opposite ends of spring wire 230 are overlapped and retained in an aperture extending through a cylindrical bushing 240 which is itself retained in apertures formed in opposite sides of a drive link 242. Furthermore, drive link 242 has square apertures therein which receive square drive rod 30 such that drive link 242 is fixed for rotation with drive rod 30.

With leg rest assembly 16 fully extended, rotation of actuation handle 42 in a forward direction (i.e. to retract leg rest assembly 16) causes corresponding rotation of drive link 242 which, in turn, causes spring wire 230 to be moved rearwardly for pivoting latching bar 218 in a direction toward drive rod 30. As such, chisel-shaped end 220 is withdrawn from one of teeth 216 in sector bracket 214. Upon release of locking mechanism 210, chair body 21 is capable of unrestricted rocking action in a well known manner. Likewise, when actuation handle 42 is selectively rotated in a rearward direction for causing leg rest assembly 16 to move to its elevated position, rotation of drive rod 30 causes simultaneous rotation of drive link 242. This action causes wire element 230 to move forwardly for forcibly pivoting latching bar 218 and thereby advancing its chisel-shaped end 220 into locked engagement with one of teeth 216 on sector bracket 214.

If it is desired to "tilt" chair body 21 rearwardly, chisel-shaped end 220 of latch bar 218 will sequentially ratchet over teeth 216 until the desired degree of tilt has been reached. In this manner, the rocking components of chair 10 are effectively "locked-out" for preventing chair body 21 from returning to its forward "non-tilted" position due to engagement of chisel-shaped end 220 of latching bar 218 with one of sector teeth 216. Thereafter, when it is desired to lower the chair body to its horizontal position from a tilted position, handle 42 is forwardly rotated to withdraw chisel-shaped end 220 of latching bar 218 from sector teeth 216 for permitting chair body 21 to assume its horizontal position while concurrently causing leg rest assembly 16 to move to its "stowed" position. It is to be understood that any suitable locking device can be readily substituted for use with chair 10 of the present invention.

As best seen in FIGS. 3 and 4, left and right spring-assist toggle assemblies 250 are provided which work coactively with leg rest pantograph linkages 34. Toggle assemblies 250 provide means for securely holding frame board 48 of leg rest assembly 16 in a fully retracted position against front rail assembly 26. Toggle assemblies 250 are also operable to supply a spring force for biasingly urging leg rest assembly 16 toward one of its extended and retracted positions. More particularly, toggle assemblies 250 each include a toggle lever 252 with a square hole which is mounted by means of the square hole on square drive rod 30 for rotation therewith. Toggle lever 252 is pivotally connected at pivot 253 to front leg 254 of a C-shaped toggle link 256 that curves around, above and to the rear of drive rod 30 where its rear leg 258 has an opening to which one end of a helical coil spring 262 is attached. The opposite end of spring 262 is attached to a spring pin 264 which is secured to a rearward portion of rocker blocks 200. While not shown, tension adjustment means may be optionally provided for adjusting the tension in spring 262. For example, the tension in spring 262 can be adjustably relieved for a lighter weight occupant or it can be increased for a heavier seat occupant. Each C-shaped toggle link 256 of toggle assemblies 250 is positively located on drive rod 30 by means of a spacer clip 41 for maintaining the desired spacing of toggle links 256 from rocker blocks 200 and rocker devices 204 in order to avoid interference therewith. As shown in FIG. 3, spacer clips 41 also positively locate leg rest drive links 178 in their desired position along drive rod 30.

Operation of toggle assemblies 250 will now be described in greater detail. The location of pivot 253 below drive rod 30 and the line of action of spring 262 are such that in the retracted position of leg rest assembly 16, the spring force acts to biasingly hold or "retain" leg rest assembly 16. As leg rest 16 is initially extended upon slight rotation of actuator lever 42 and, in turn, drive rod 30, pivot 253 moves up and over center of an imaginary line between the axis of spring pin 264 and the drive rod axis. Once pivot 253 is over-center, tension loading on spring 262 assists in drivingly rotating drive rod 30 for elevating leg rest assembly 16 as rear leg 258 of link 256 is pulled toward spring pin 264. In addition, spring 262 assists the seat occupant in pivoting handle 42 through the required actuation angle. In similar fashion, toggle assembly 250 is adapted to utilize the spring biasing force of spring 262 to assist in returning leg rest assembly 16 to its stowed position upon reverse rotation of handle 42.

In accordance with the principles of the present invention, a unique method for assembling the various "modular" pre-assembled frame components and actuation mechanism 12 into reclining/rocking chair 10 will now be described in greater detail. In addition, the improved method of the present invention permits sequential assembly of the pre-assembled and/or upholstered components in a simple and efficient manner for significantly reducing overall system complexity, weight, and cost while promoting superior quality and reliability.

Figure 5A:
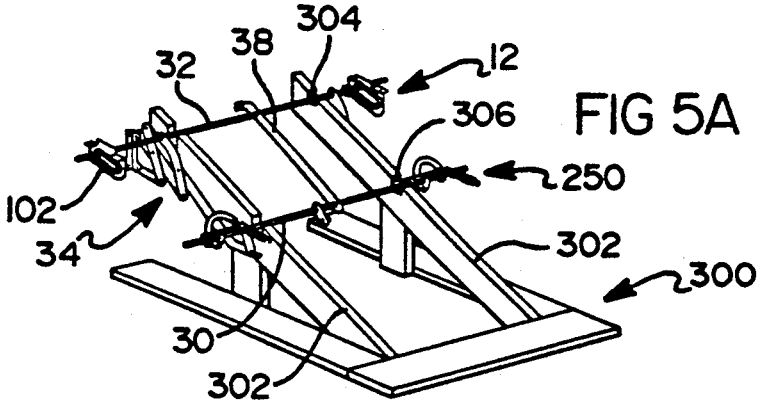
FIGS. 5A through 5H are various perspective views provided to illustrate a preferred method for assembling the reclining chair apparatus of FIGS. 1 and 3.

With particular reference now to FIG. 5A, pre-assembled actuation mechanism 12 is shown retained on a suitable holder or "jig" 300. Jig 300 includes a pair of spaced and angularly extending stantions 302 having first and second sets of aligned notches 304 and 306, respectively. As can be seen, the first set of aligned notches 304 is provided for retaining support shaft 32 therein while the second set of aligned notches 306 is provided for retaining drive rod 30 therein. As previously noted, the various components associated with slide brackets 102, pantograph linkages 34, drive link 242, cross-brace 38, and toggle assemblies 250 are all operably coupled to, or suspended from, actuation mechanism 12 prior to interconnection with the various frame components. Alternatively, jig 300 may be used as an appropriate situs for assembling the various linkages and components associated with actuation mechanism 12.

Figure 5B:
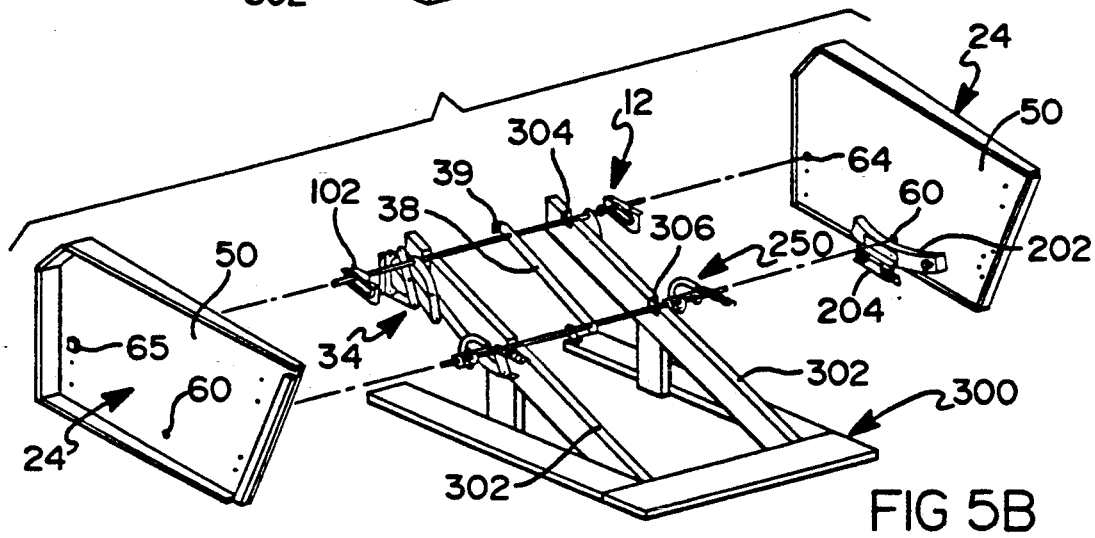

With reference now to FIG. 5B, the assembly step for orienting and interconnecting side frame assemblies 24 with actuation mechanism 12 is clearly shown. As will be appreciated, side frame assemblies 24 have been pre-assembled to include rocker blocks 200, spring pins 264, and rocker spring devices 204. While not shown, it is to be understood that the requisite padding, lining, decorative upholstery and the like have also been installed on side frame assemblies 24 prior to assembly with actuation mechanism 12. As seen, drive rod 30 and support shaft 32 are of sufficient length such that side frame assemblies 24 can be retained thereon. More specifically, the upholstered side frame assemblies 24 are positioned on actuation mechanism 12 such that the opposite ends of drive rod 30 extend through the first set of aligned bores 60 formed in side panels 50 (i.e. the first set of "fixed" pivot points). Similarly, the opposite ends of support shaft 32 are seated with the second set of aligned bores 64 formed in side panels 50 (i.e. the second set of "fixed" pivot points).

Figure 5C:
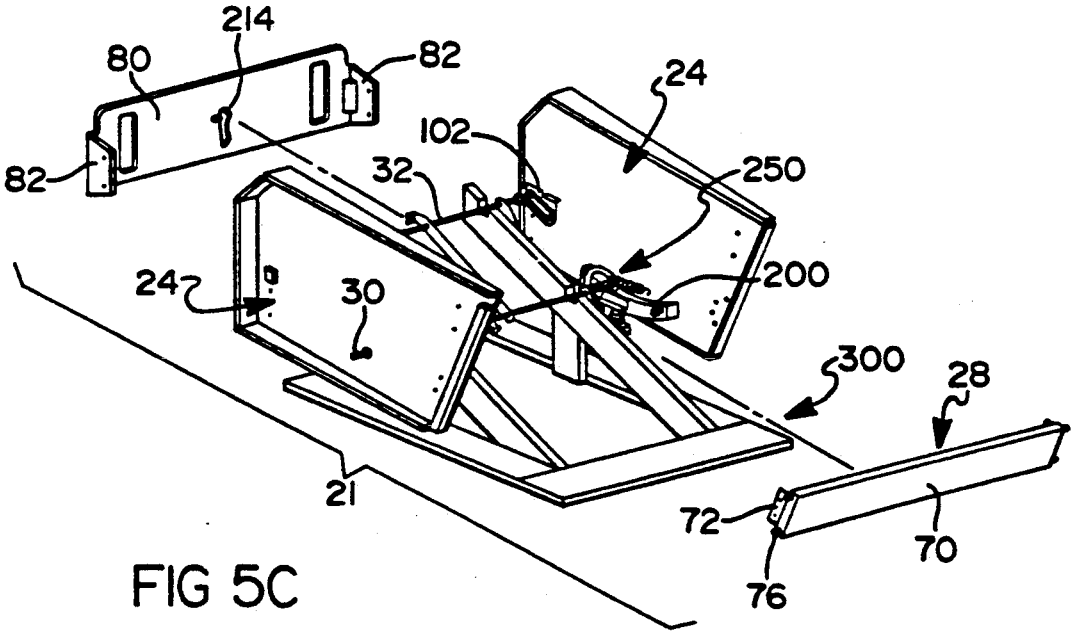

As seen in FIG. 5C, the four primary pre-assembled frame components include left and right side frame assemblies 24 and front and rear rail assemblies 26 and 28, respectively. In accordance with a preferred assembly procedure, dowel pins 76 on opposite ends of rear cross-member 70 are inserted with glue into locator holes 78 formed in side panels 50 for properly aligning and locating rear rail assembly 28 with respect to the left and right side frame assemblies 24. Thereafter, threaded fasteners are threadably driven through bores in angled bracket 72 and into T-nuts retained within bores 79 formed of side panels 50 for securing rear rail assembly 28 between the left and right side frame assemblies 24. Complete tightening of the threaded fasteners is typically deferred until front rail assembly 26 has also been secured to side frame assemblies 24. As noted, an upholstered "tailgate" (not shown) may be secured to rear rail assembly 28 in those applications wherein rear rail assembly 28 is not upholstered.

Following interconnection of rear rail assembly 28, glue is applied to side plates 82 of front rail assembly 26 and they are slid inwardly between left and right side frame assemblies 24 in such a manner to permit portions of pantograph linkages 34 to project through apertures 84 formed in front cross-member 80. As shown in FIG. 5C, rachet bracket 214 has been pre-assembled to a rear surface of front cross-member 80. In addition, front cross-member 80 has been upholstered prior to assembly. Bores 86 formed in side plates 82 are aligned with bores 88 formed in side panels 50 such that threaded fasteners are thereafter driven through bores 86 and 88 for rigidly securing front rail assembly 26 to side frame assemblies 24. Thereafter, cross-brace bracket 39 is securely attached to front cross-member 80 to provide additional structural rigidity.

Figure 5D:
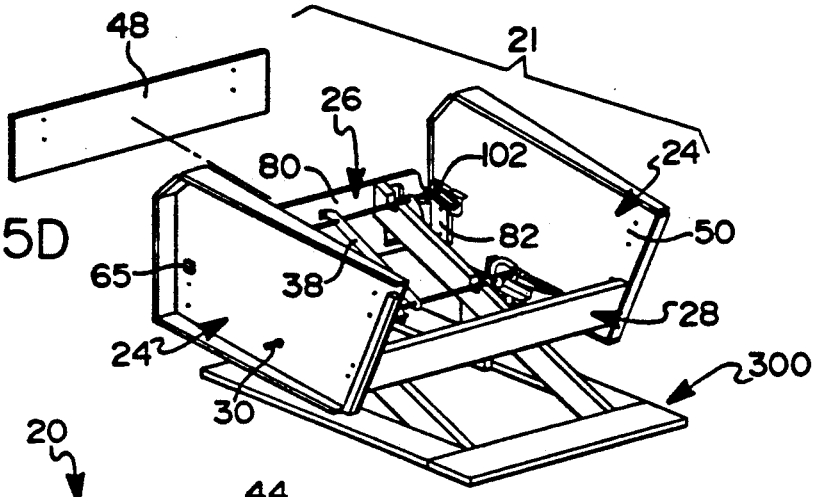

FIG. 5D illustrates the integrated and interdependent relationship of the four primary frame components which, when assembled, define an extremely rigid "box-like" upholstered chair body 21 within which actuation mechanism 12 is suspended. As noted, this "integrated" construction permits the elimination of the separate mechanism frame assembly conventionally provided for supporting the actuation mechanisms in prior known reclining chairs. As seen, jig 300 is designed to permit the various frame components to be interconnected in an extremely efficient manner. Following assembly of chair body 21, frame board 48 is fixedly secured to angled brackets 140 of pantograph linkages 34. Again, it is to be understood that frame board 48 has been pre-assembled as an upholstered unit prior to being assembled as part of chair body 21.

Figure 5E:
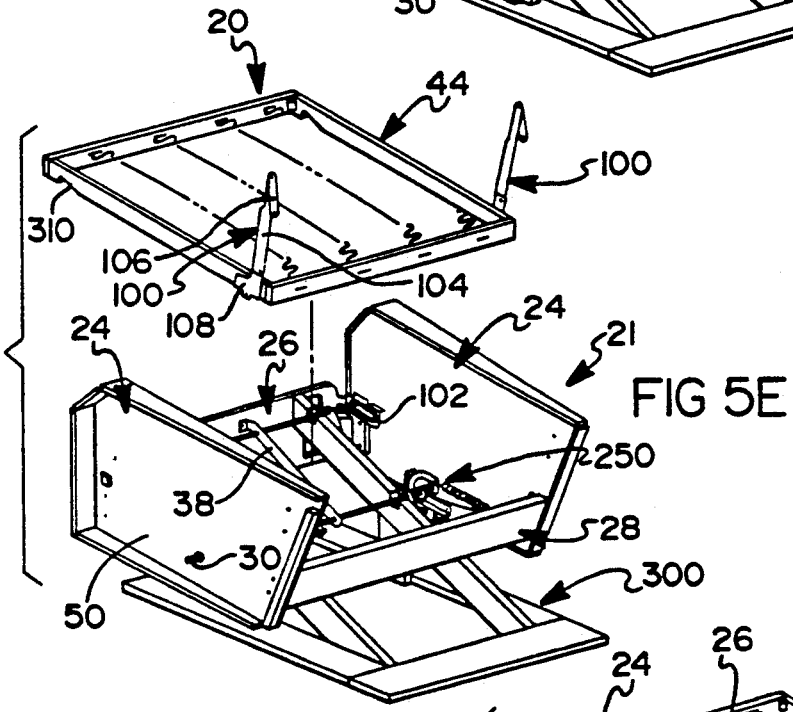

With particular reference now to FIG. 5E, the four pre-assembled frame components defining chair body 21 are shown supported from jig 300 with actuation mechanism 12 integrally suspended therefrom. In accordance with the next operation, upholstered seat 20 (which includes seat frame 44 with its appropriate upholstery padding and springs) is interconnected to chair body 21. More particularly, notches 310 formed in the front underside edges of seat frame side bars 90 are provided for aligning seat frame 44 with respect to support shaft 32. Next, rear swing linkages 100, which have been pre-assembled onto upholstered seat 20, are fixedly secured to side panels 50 via support brackets 106. Once support brackets 106 are fixedly secured to side panels 50 (via suitable fasteners), pivot points 110 between swing links 104 and support brackets 106 are operable to define the third set of "fixed" pivot points about which seat assembly 14 is reclinable. Alternatively, support brackets 106 of rear swing linkages 100 can be initially mounted directly to side panels 50 such that angled brackets 108 can be thereafter secured to upholstered seat 20. In this manner, seat 20 can be "flipped over" to permit seat brackets 108 to be securely fastened to side bars 90 of seat frame 44. With seat frame 44 positioned such that support shaft 32 is located in notches 310, slide brackets 102 are pulled inwardly against the biasing force of springs 122 until vertically extending flanges 119 abuttingly engage the inner surface of seat frame side bars 90. Thereafter, suitable fasteners (such as wood screws) are driven through holes in horizontal flanges 118 to securely fix slide brackets 102 to an underside surface of seat side bars 90.

Figure 5F:
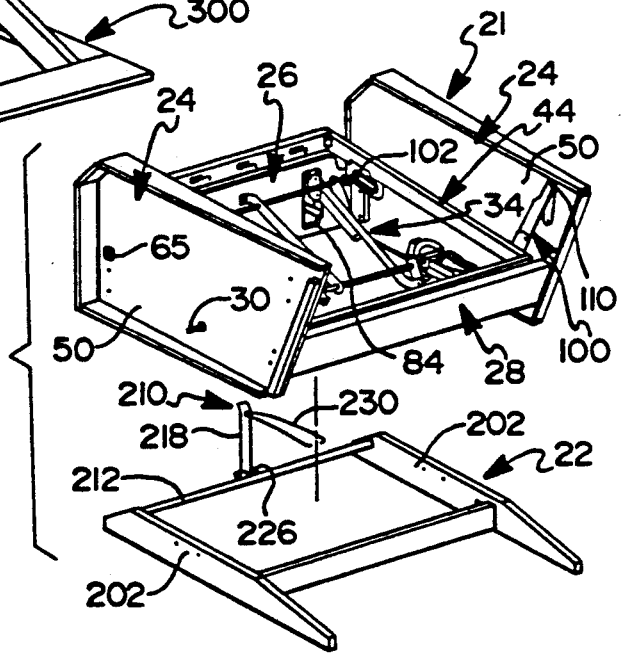
Figure 5G:
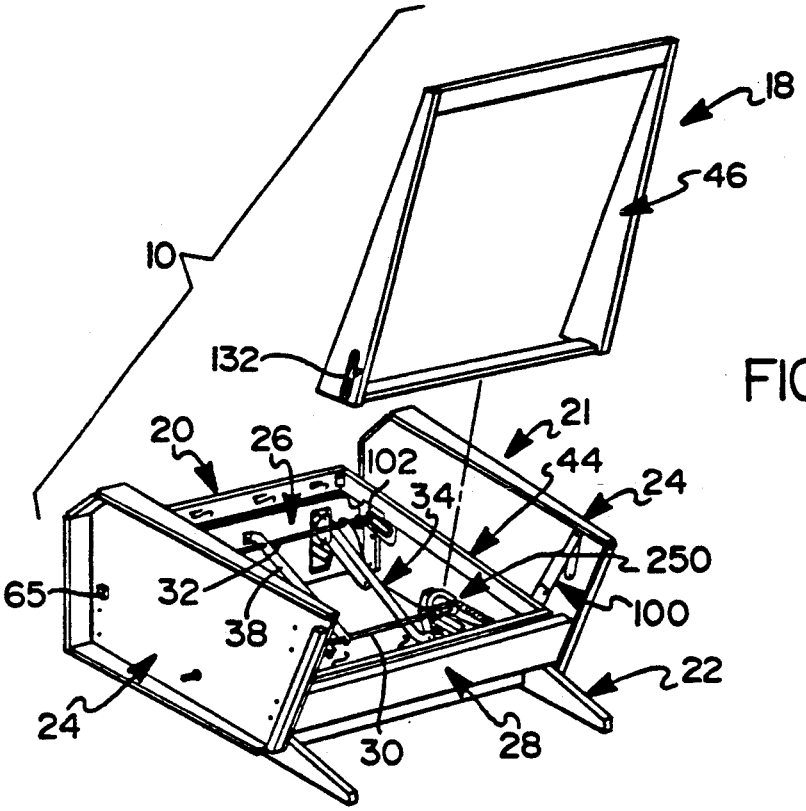
Figure 5H:
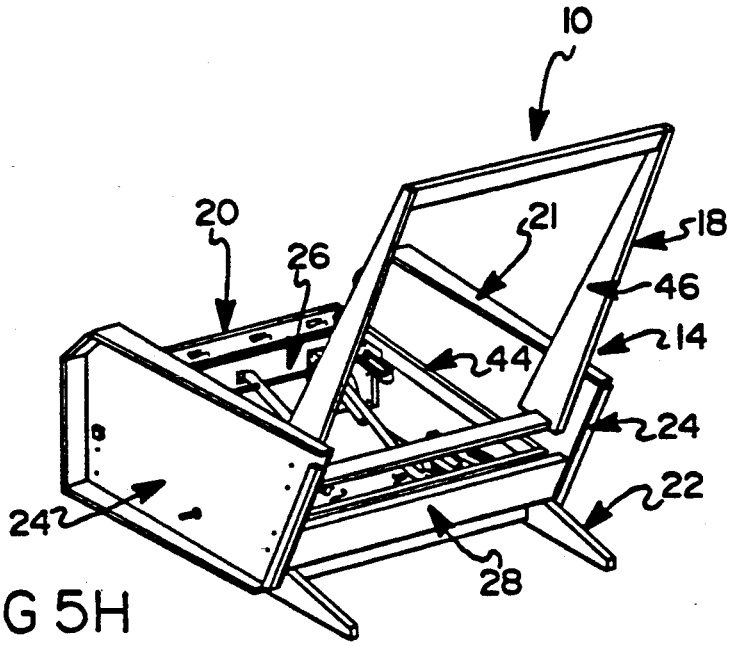

With particular reference now to FIG. 5F, base assembly 22 is shown pre-assembled to include various components of locking apparatus 210 such as latch bar 218 and mounting bracket 226 secured to front cross-rail 212 of base assembly 22. Chair body 21 is removed from jig 300 and is placed in proper alignment with respect to base assembly 22 such that rocker blocks 200 rest on side rails 202 of base assembly 22. Thereafter, rocker spring devices 204, shown pre-assembled to extend downwardly from rocker blocks 20, are fixedly secured to the inner face surfaces of side rails 202 of base assembly 22 via suitable fasteners. Thereafter, the opposite ends of spring wire 230 are secured to drive link 242 for completing the operative assembly of locking mechanism 210. Finally, FIGS. 5G and 5H illustrate the manner in which upholstered seat back 18 can be detachably secured to seat 20 via swing links 104 and slide brackets 130.

As is relatively apparent from examination of FIGS. 5A through 5H, the preassembled components can be interconnected in a number of other acceptable sequential operations to produce "knock-down" or modular chair 10. The method of assembly disclosed herein is advantageous in that virtually all of the components can be pre-assembled "off-line" for quick and efficient modular interconnection in a highly repeatable and precise fashion.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for assembling a reclining chair comprising:

providing means defining a chair frame having side frame members interconnected with cross rail members;

suspending an actuation mechanism between said side frame members;

pivotally interconnecting a seat and seat back; and operably connecting said interconnected seat and seat back to said chair frame for reclining movement.

2. The method of claim 1 further comprising:

connecting said seat to said actuation mechanism for guiding the longitudinal movement of said seat in response to said reclining movement of said seat assembly.

3. The method of claim 2 further comprising the steps of:

providing a stationary base; and interconnecting said chair frame to said base so as to permit rocking movement of said chair frame with respect to said base.

4. The method of claim 3 further comprising the step of interconnecting locking means between said base and said chair frame for releasably locking said chair frame in a tilted position.

5. The method of claim 1 further comprising the step of upholstering said side frame members and said cross rail members prior to interconnection into said chair frame.

6. The method of claim 1 wherein said step of suspending said actuation mechanism comprises:

providing alignment means associated with said side frame members for aligning said actuation mechanism; and aligning said actuation mechanism to said alignment means.

7. The method of claim 6 wherein said actuation mechanism includes first and second shafts, said alignment means comprises a first and second set of bores formed in said side frame members, and said step of aligning said actuation mechanism comprises:

inserting opposite ends of said first shaft within said first set of alignable bores; and inserting opposite ends of said second shaft within said second set of alignable bores.

8. The method of claim 7 further comprising:

providing swing link means for pivotally interconnecting said seat to said seat back; and connecting said swing link means to said side frame members for suspending said seat assembly therebetween, said swing link means operable to permit reclining movement of said seat assembly with respect to said chair frame between an upright position and a reclined position.

9. The method of claim 8 wherein said step of connecting said swing link means to said side frame members comprises:

providing alignment means associated with said side frame members for aligning said swing link means therebetween; and aligning said swing link means to said alignment means.

10. The method of claim 9 wherein said alignment means comprises a third set of alignable bores formed in said side frame member and said step of aligning said swing link means comprises:

connecting said swing link means to said third set of alignable bores;

providing guide means for guiding and limiting fore and aft movement of said seat with respect to said first shaft in response to reclining movement of said seat assembly; and connecting a frame portion of said seat to said guide means.

11. The method of claim 7 wherein one of said first and second shafts is a drive rod and said other of said first and second shafts is a support shaft, said method further comprising the step of:

operatively supporting a leg rest assembly from said support shaft and said drive rod for movement between a retracted position and an extended position in response to selective rotation of said drive rod.

12. The method of claim 11 wherein said leg rest assembly comprises linkage means and biasing means for retaining said leg rest assembly in said retracted position when said drive rod is rotated to a first position and in said extended position when said drive rod is rotated to a second position, said method further comprising the step of:

assembling said linkage means and said biasing means to said drive rod and support shaft prior to installation thereof within said chair frame.

13. A reclinable seating unit including a pair of side frame members having at least two sets of alignable bores formed therein, a front cross frame member, a rear cross frame member, a mechanical actuation mechanism comprising a support shaft and a drive rod each transversely extending between said side frame members, a leg rest mechanism suspended from said support shaft and having a pair of pantograph linkages projecting through a pair of elongated apertures formed in said front cross frame member, a leg rest frame board, a seat assembly having a seat, a seat back, and swing link means for pivotally interconnecting said seat and seat back to said side frame members, said swing link means operable to permit reclining movement of said seat assembly between an upright position and a reclined position in response to pressure applied by a seat occupant to said seat back, and guide means operable for guiding and limiting longitudinal movement of said seat with respect to said support shaft in response to reclining movement of said seat assembly, the improvement comprising assembling said reclinable seating unit by:

assembling said mechanical actuation mechanism to include said drive rod, said support shaft, means for rigidly interconnecting said drive rod and support shaft in a predetermined orientation, said pair of pantographic linkages journally supported on said support shaft and drivingly coupled to said drive rod for movement between a retracted position and an extended position in response to selective rotation of said drive rod, and said guide means, said guide means comprising a pair of slide brackets having slot means formed therein through which opposite ends of said support shaft extend;

inserting opposite ends of said drive rod into a first set of said alignable bores for journally suspending said drive rod between said side frame members;

inserting opposite ends of said support shaft into a second set of said alignable bores for seating said support shaft between said side frame members;

interconnecting said cross frame members between front and rear portions of said side frame members to define a rigid chair body from which said mechanical actuation mechanism is integrally suspended;

connecting said swing link means to said side frame members for suspending said seat assembly therefrom;

connecting said slide brackets to said seat member such that said slot means coact with said support shaft to guide and limit the longitudinal movement of said seat during reclining movement of said seat assembly;

mounting said leg rest frame board to said pair of pantographic linkages for movement thereof between said retracted and extended positions; and coupling a manually-operable means to said drive rod for permitting said seat occupant to selectively rotate said drive rod for driving said pantographic linkages and said leg rest frame board between said retracted and extended positions.

14. A method of modular assembly for a reclining chair, said method comprising the steps of:

providing an actuation mechanism having first and second shafts;

providing a pair of side frame members;

inserting opposite ends of said first shaft into a first set of alignable bores formed in said side frame members for suspending said first shaft therebetween;

inserting opposite ends of said second shaft into a second set of alignable bores formed in said side frame members for suspending said second shaft therebetween;

connecting front and rear cross frame members between said side frame members to define a chair frame, said actuation mechanism being integrally retained within said chair frame;

providing a seat back, a seat member, and swing linkage means for pivotably interconnecting said seat member and seat back to permit reclining movement therebetween in response to pressure applied by a seat occupant to said seat back;

connecting said swing linkage means to a third set of alignable bores formed in said side frame members;

connecting said seat member to guide means for permitting fore and aft longitudinal movement of said seat member with respect to said chair frame, said guide means being operably associated with said first shaft for defining the limits of said fore and aft movement of said seat member; and detachably securing said seat back to said swing linkage means such that said seat back and seat member are moveable between an upright position and a reclined position.

15. The method of claim 14 wherein said first shaft of said actuation mechanism is a front support shaft and said second shaft is a drive rod, said drive rod and said support shaft being rigidly maintained in a predetermined spatial arrangement to permit sliding insertion of the opposite ends thereof into said first and second sets of alignable bores formed in said side frame members, and wherein said drive rod is selectively rotatable with respect to said second set of alignable bores while said support shaft is inhibited from rotation within said first set of alignable bores in response to rotation of said drive rod.

16. The method of claim 15 further comprising the step of operably supporting a leg rest assembly between said support shaft and said drive rod, said leg rest assembly being moveable between a retracted position and an extended position in response to selective rotation of said drive rod.

17. The method of claim 16 wherein said leg rest assembly includes a leg rest frame board and pantograph linkage means journally suspended on said front support shaft and drivingly coupled to said drive rod for moving said leg rest frame board between said retracted and extended positions in response to selective actuation of said drive rod.

18. The method of claim 17 wherein said actuation mechanism further includes an over-center linkage operatively coupled to said drive rod, spring means coactive with said over-center linkage for biasingly retaining said leg rest assembly in said retracted position when said drive rod is rotated to a first position and for biasingly driving said leg rest assembly toward said extended position when said drive rod is rotated to a second position, and means for permitting said seat occupant to selectively rotate said drive rod between said first position and second positions.

19. The method of claim 18 further comprising the step of assembling said pantograph linkage means and said over-center linkage to said drive rod and said support shaft of said actuation mechanism prior to installation thereof between said side frame members.

20. The method of claim 18 further comprising the steps of:

providing a stationary base assembly; and interconnecting said rigid chair frame to said base assembly so as to permit rocking movement of said chair frame with respect to said base assembly, and wherein said rocking movement is independent of said reclining movement between said seat member and said seat back.

21. The method of claim 20 further comprising the step of interconnecting a locking mechanism between said base assembly and said chair frame operable for releasably locking said chair frame in a rearwardly tilted position when said drive rod is in said second position, said locking means being operable to permit said rocking movement when said drive rod is in said first position.

22. The method of claim 14 further comprising the steps of:

providing a stationary base assembly; and interconnecting said rigid chair frame to said base assembly so as to permit rocking movement of said chair frame with respect to said base assembly, and wherein said rocking movement is independent of said reclining movement between said seat member and said seat back.

23. The method of claim 22 further comprising the step of interconnecting a locking mechanism between said base assembly and said chair frame for permitting said seat occupant to releasably lock said chair frame in a rearwardly tilted position when said locking mechanism is in a first position, said locking mechanism also being operable to permit said rocking movement of said chair frame when said locking mechanism is in a second position.

24. A method for assembling a reclining chair comprising the steps of:

assembling a mechanical actuation mechanism to include a drive rod, a support shaft, means for rigidly interconnecting said drive rod and support shaft in a predetermined orientation, a pair of pantographic linkages journally supported on said support shaft and drivingly coupled to said drive rod for movement between a retracted position and an extended position in response to selective rotation of said drive rod, and a pair of slide brackets having slot means through which opposite ends of said support shaft extend;

providing a pair of side frame members having a side panel constructed to include at least two sets of alignable bores formed therein;

inserting opposite ends of said drive rod into said first set of alignable bores for journally suspending said drive rod between said side frame members;

inserting opposite ends of said support shaft into said second set of aligned bores for seating said support shaft between said side frame members;

interconnecting cross frame members between front and rear portions of said side frame members to define a rigid chair body from which said actuation mechanism is integrally suspended;

providing a seat assembly having a seat, a seat back, and swing link means for pivotably interconnecting said seat and seat back to permit movement between an upright position and a reclined position with respect to said chair body in response to pressure applied by a seat occupant to said seat back;

connecting said swing link means to said side frame members for suspending said seat assembly therefrom;

connecting said slide brackets to said seat member such that said slot means coact with said support shaft to guide and limit the longitudinal movement of said seat during reclining movement of said seat assembly;

mounting a leg rest frame member to said pair of pantographic linkages for movement thereof between said retracted and extended positions; and coupling manually-operable means to said drive rod for permitting said seat occupant to selectively rotate said drive rod for driving said pantographic linkages between said retracted and extended positions.

25. The method of claim 24 further including the step of connecting an over-center spring-assisted linkage mechanism between said drive rod and said chair body for biasingly urging said pantographic linkages between said retracted and extended positions upon rotation of said drive rod.

26. The method of claim 24 further comprising the steps of:

providing a stationary base assembly; and interconnecting said rigid chair frame to said base assembly so as to permit rocking movement of said chair body with respect to said base assembly, and wherein said rocking movement is independent of said reclining movement of said seat assembly.

27. The method of claim 23 further comprising the step of interconnecting a locking mechanism between said base assembly and said chair body for permitting said seat occupant to releasably lock said chair body in a multitude of rearwardly tilted positions.

28. The method of claim 24 wherein said side frame members, said cross frame members, said seat back, said seat, and said leg rest frame member are upholstered prior to modular assembly into said reclining chair.

29. The method of claim 24 wherein said cross frame members and said side frame members are interconnected at their respective end portions such that said chair body comprises a frame.

30. The method of claim 29 wherein said cross frame member interconnecting the front end portions of said side frames comprises a one-piece member having a pair of enlarged apertures through which said pair of pantograph linkages move between said retracted and extended positions.

31. A method for assembling a reclining chair comprising:

providing an actuation mechanism;

suspending said actuation mechanism between a pair of side frame members;

interconnecting cross rail members with said side frame members to define a chair frame within which said actuation mechanism is operably supported;

providing a seat assembly having a seat, a seat back, and swing link means for pivotally interconnecting said seat back and said seat;

connecting said swing link means to said side frame members for suspending said seat assembly therebetween, said swing link means operable to permit reclining movement of said seat assembly with respect to said chair frame between an upright position and a reclined position in response to pressure applied by a seat occupant to said seat back; and connecting said seat to said actuation mechanism for guiding the longitudinal movement of said seat in response to said reclining movement of said seat assembly.

32. The method of claim 31 wherein said actuation mechanism includes first and second shafts, and wherein said step of suspending said actuation mechanism comprises:

inserting opposite ends of said first shaft within a first set of alignable bores formed in said side frame members for supporting said first shaft therebetween; and inserting opposite ends of said second shaft within a second set of alignable bores formed in said side frame members for supporting said second shaft therebetween.

33. The method of claim 32 wherein said steps of connecting said swing link means and said seat comprise:

connecting said swing link means to a third set of alignable bores formed in said side frame members;

providing guide means for guiding and limiting the fore and aft movement of said seat with respect to said first shaft in response to reclining movement of said seat assembly; and connecting a frame portion of said seat to said guide means.

34. The method of claim 32 wherein said first shaft of said actuation mechanism is a front support shaft and said second shaft is a drive rod, said drive rod and said support shaft being rigidly maintained in a predetermined spatial arrangement to permit sliding insertion of the opposite ends thereof into said first and second sets of alignable bores formed in said side frame members, and wherein said drive rod is selectively rotatable with respect to said second set of alignable bores while said support shaft is inhibited from rotation within said first set of alignable bores in response to rotation of said drive rod.

35. The method of claim 34 further comprising the step of operably supporting a leg rest assembly from said front support shaft and said drive rod of said actuation mechanism for movement between a retracted position and an extended position in response to selective rotation of said drive rod, said movement of said leg rest assembly being independent from said reclining movement of said seat assembly.

36. The method of claim 35 wherein said leg rest assembly includes a leg rest frame board and a pantograph linkage, said pantograph linkage being journally suspended from said support shaft and directly coupled to said drive rod such that selective rotation of said drive rod moves said leg rest frame board between said retracted and extended positions.

37. The method of claim 36 wherein said actuation mechanism further includes an over-center linkage coupled to said drive rod, spring means coactive with said over-center linkage for biasingly retaining said leg rest assembly in said retracted position when said drive rod is rotated to a first position and for biasingly driving said leg rest assembly toward said extended position when said drive rod is rotated to a second position, and means for permitting said seat occupant to selectively rotate said drive rod between said first position and second positions.

38. The method of claim 37 further comprising the step of assembling said pantograph linkage and said over-center linkage to said drive rod and said support shaft of said actuation mechanism prior to installation thereof between said side frame members.

39. The method of claim 37 further comprising the steps of:

providing a stationary base assembly; and interconnecting said rigid chair frame to said base assembly so as to permit rocking movement of said chair frame with respect to said base assembly, said rocking movement being independent of said reclining movement of said seat assembly.

40. The method of claim 39 further comprising the step of interconnecting locking means between said base assembly and said chair frame for releasably locking said chair frame in a rearwardly tilted position when said drive rod is in said second position, said locking means being operable to permit said rocking movement when said drive rod is in said first position.

41. The method of claim 34 further comprising the step of upholstering said left and right side frame members and said cross frame members prior to interconnection into said rigid chair frame.

42. The method of claim 34 further comprising the steps of:

providing a stationary base assembly; and interconnecting said rigid chair frame to said base assembly so as to permit rocking movement of said chair frame with respect to said base assembly, said rocking movement being independent of said reclining movement of said seat assembly.

43. The method of claim 42 further comprising the step of interconnecting locking means between said base assembly and said chair frame for permitting said seat occupant to releasably lock said chair frame in a rearwardly tilted position when said locking means is in a first position, said locking means also being operable to permit said rocking movement of said chair frame when said locking means is in a second position.

* * * * *